United States Patent [19]

Müller

[11] Patent Number: 4,589,603

[45] Date of Patent: May 20, 1986

[54] APPARATUS FOR TEMPORARY STORAGE OF A STREAM OF PARTIALLY OVERLAPPING SHEETS

[75] Inventor: Hans Müller, Zofingen, Switzerland

[73] Assignee: Grapha-Holding AG, Hergiswil, Switzerland

[21] Appl. No.: 678,242

[22] Filed: Dec. 5, 1984

Related U.S. Application Data

[63] Continuation-in-part of Ser. No. 572,562, Jan. 18, 1984.

[30] Foreign Application Priority Data

Jan. 21, 1983 [CH] Switzerland ..... 348/83
Dec. 8, 1983 [CH] Switzerland ..... 6569/83

[51] Int. Cl.[4] ..... B65H 29/70; B65B 63/04
[52] U.S. Cl. ..... 242/59; 53/430
[58] Field of Search ..... 242/59, 75.44, 75.51, 242/75.45, 75.47; 198/347, 750, 778; 53/430, 118, 389

[56] References Cited

U.S. PATENT DOCUMENTS

| | | | |
|---|---|---|---|
| 3,650,490 | 3/1972 | Saunders | 242/75.51 X |
| 3,673,473 | 6/1972 | Werner | 242/75.51 X |
| 4,126,817 | 11/1978 | Luzio | 242/75.51 X |
| 4,438,618 | 3/1984 | Honegger | 242/59 X |
| 4,494,359 | 1/1985 | Honegger | 53/430 |
| 4,494,705 | 1/1985 | Linder | 242/59 |

FOREIGN PATENT DOCUMENTS

| | | | |
|---|---|---|---|
| 3123888 | 5/1982 | Fed. Rep. of Germany . | |
| 2092557 | 8/1982 | United Kingdom | 242/59 X |

*Primary Examiner*—Stuart S. Levy
*Assistant Examiner*—Lynn M. Sohacki
*Attorney, Agent, or Firm*—Peter K. Kontler

[57] ABSTRACT

Apparatus for temporary storage of partially overlapping paper sheets has a first rotor driven by a first variable-speed motor and a second rotor driven by a second variable-speed motor. The first and second ends of an elastic band are connected to the respective rotors and a conveyor system delivers successive sheets onto the band ahead of the location where the unconvoluted portion of the band merges into the outermost convolution when the first rotor is driven in a direction to collect the band. The radius of the growing roll of sheets and convolutions of the band on the first rotor is monitored by a first detector which transmits corresponding signals to a signal processing circuit further receiving signals which denote the speed of the conveyor system. Such signals are processed to form a third signal denoting the desired angular speed of the roll on the first rotor, and the third signal is compared with a fourth signal which denotes the actual angular speed of the first rotor. The motor for the first rotor is adjusted when the angular speed of the roll deviates from the desired speed as denoted by the third signal.

12 Claims, 4 Drawing Figures

APPARATUS FOR TEMPORARY STORAGE OF A STREAM OF PARTIALLY OVERLAPPING SHEETS

CROSS-REFERENCE TO RELATED CASE

This is a continuation-in-part of the commonly owned copending patent application Ser. No. 572,562 filed Jan. 18, 1984.

BACKGROUND OF THE INVENTION

The present invention relates to apparatus for temporary storage of sheets, especially folded-over paper sheets, and more particularly to improvements in apparatus which can be utilized with advantage for temporary storage of partially overlapping sheets in newspaper printing plants and analogous establishments. Still more particularly, the invention relates to improvements in apparatus of the type wherein the sheets are stored between neighboring convolutions of a flexible band which is coiled around a motor-driven rotor, e.g., a core which is permanently or detachably connected with one end of the band.

German Offenlegungsschrift No. 31 23 888 discloses an apparatus wherein the outermost convolution of the band on the rotor is biased by a pivotable lever so as to effect a compression of sheets at the location where they contact the next-to-the-outermost convolution of the band. A drawback of the apparatus which is disclosed in this German printed publication is that it employs a highly complex and expensive unit which is supposed to synchronize the peripheral speed of the growing roll on the rotor with the speed of the stream of paper sheets which are being delivered to the band. Moreover, the tension of the band is changed in automatic response to each change in the speed of oncoming sheets and this affects the condition of the stored sheets, especially of folded-over paper sheets which can constitute inserts of newspapers or analogous publications.

OBJECTS AND SUMMARY OF THE INVENTION

An object of the invention is to provide a novel and improved apparatus for temporary storage of paper sheets or the like between the convolutions of a flexible band in such a way that the peripheral speed of the growing or decreasing roll of convoluted material invariably conforms to the speed of the oncoming sheets.

Another object of the invention is to provide a novel and improved synchronizing system which can be utilized in the above outlined apparatus to conform the peripheral speed of the roll of convoluted material to the speed of the stream of sheets which are being fed to or advanced from the storing station.

A further object of the invention is to provide an apparatus wherein the tension of the band between the rotor which stores sheets and the rotor which gathers the band when the sheets are being discharged from storage can be regulated in a novel and improved way.

An additional object of the invention is to provide the apparatus with novel and improved means for regulating the tension of the band between the two rotors.

A further object of the invention is to provide novel and improved means for regulating the RPM of each of the two rotors.

Still another object of the invention is to provide a novel and improved method of manipulating the above outlined apparatus.

Another object of the invention is to provide the apparatus with a synchronizing system which is not only simpler and less expensive than heretofore known synchronizing systems but is also more reliable and more versatile than the conventional systems.

An additional object of the invention is to provide a novel and improved control system for use in an apparatus of the above outlined character.

The invention is embodied in an apparatus for temporary storage and paying out a stream of sheets, particularly a stream of partially overlapping folded-over paper sheets. The improved apparatus comprises first and second rotors (e.g., two parallel horizontal cores), a band having first and second end portions which are respectively affixed to the first and second rotors and an elongated median portion which is convoluted on the second rotor prior to storing of sheets on the first rotor and which is convoluted on the first rotor prior to paying out of the stored sheets, adjustable drive means (e.g., a variable-speed polyphase current electric motor) for rotating the first rotor at a variable speed in a direction to convolute the band thereon with attendant unwinding of the band from the second rotor, variable-speed conveyor means (e.g., a series of two or more endless belt or chain conveyors) for supplying the sheets of the stream onto the median portion of the band at a predetermined location intermediate the rotors so that the sheets are confined between the convolutions of the band when the first rotor is rotated in the aforementioned direction whereby the first rotor accumulates a growing roll of convoluted sheets alternating with the convolutions of the band when the first rotor is driven in the aforementioned direction, and the first rotor pays out the band and the stored sheets when the second rotor is rotated in a direction to collect the band, first detector means (e.g., a tachometer generator) serving to monitor the speed of the conveyor means and to generate first signals denoting the speed of the conveyor means, second detector means (e.g., including an adjustable potentiometer) serving to monitor the radius of the roll on the first rotor and to generate second signals denoting the momentary radius, means for processing the first and second signals and for generating third signals denoting the desired angular speed of the first rotor, third detector means (e.g., a second tachometer generator) serving to monitor the angular speed of the first rotor and to generate fourth signals denoting the monitored or actual angular speed of the first rotor, and means for adjusting the drive means when the characteristics of the third signals deviate from those of the fourth signals so that the actual angular speed of the first rotor matches the desired speed.

The second detector means can comprise a pivotable lever, means (e.g., a fluid-operated motor) for biasing the lever against the outermost convolution of the band which is convoluted onto the first rotor, and means (such as the aforementioned potentiometer) for generating the second signals as a function of the angular position of the lever.

The apparatus preferably further comprises adjustable second drive means (e.g., a variable-speed polyphase current electric motor) which serves to rotate the second rotor independently of the drive means for the first rotor, means for biasing or tensioning the band with a variable force intermediate the aforementioned location and the second rotor (i.e., upstream of the aforementioned location, as considered in the direction of advancement of the band when the first rotor is driven to collect the band thereon), fourth detector means (e.g., including an adjustable potentiometer) which serves to monitor the bias of the biasing or tensioning means and to generate fifth signals denoting the monitored bias or tension, and regulating means for adjusting the speed of the second drive means including means for comparing the fifth signals with a predetermined reference signal. The second drive means is preferably designed to brake the second rotor when the drive means for the first rotor is operative to cause the first rotor to collect the band thereon. The just described apparatus preferably further comprises means (e.g., a pressure regulating valve for a fluid-operated motor of the biasing means) for varying the force of the biasing means. Such force varying means is preferably adjustable and the apparatus then further comprises second regulating means including means for comparing the second signals with a signal denoting the actually applied force and for adjusting the force varying means when the characteristics of the second signal deviate from those of the signal denoting the actually applied force. The second regulating means preferably includes means for reducing the force of the biasing means in response to increasing radius of the roll on the first rotor and vice versa, i.e., means for adjusting the force varying means so that the magnitude of the force of the biasing means increases when the radius of the roll on the first rotor decreases and vice versa so that the product of P and R is at least substantially constant (R is the radius of the roll and P is the force of the biasing means).

The band is preferably at least slightly elastic.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
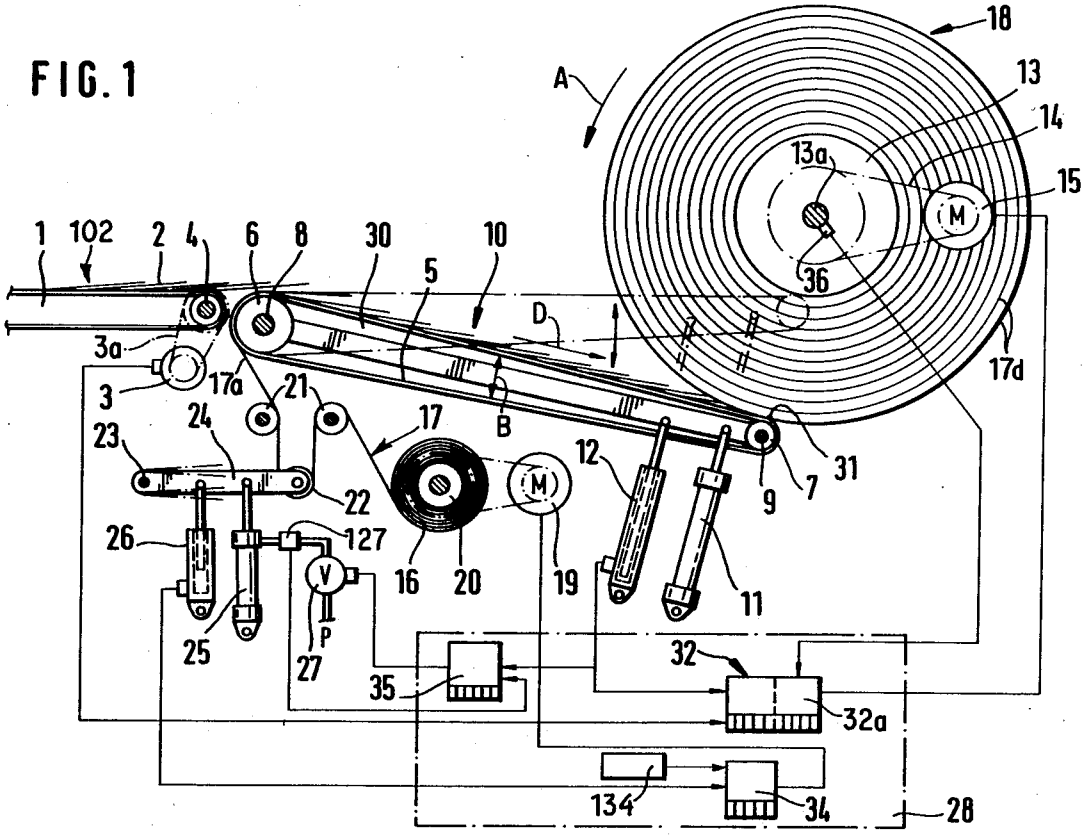
FIG. 1 is a schematic elevational view of an apparatus which embodies the invention, portions of the apparatus being shown in a longitudinal vertical sectional view and the major part of the median portion of the elastic band being convoluted on the second rotor.
Figure 2:
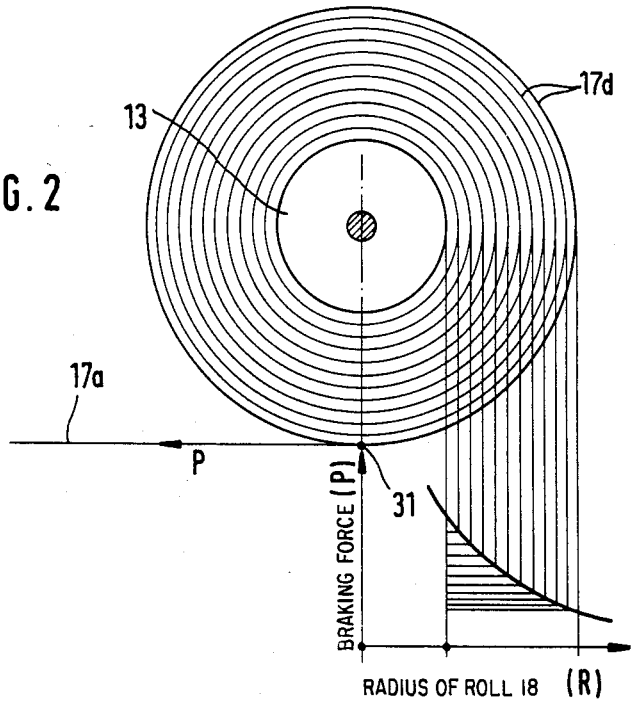
FIG. 2 shows a portion of the roll on the first rotor and a coordinate system wherein the curve represents the changes of the braking moment upon the second rotor as a function of changes in the radius of the roll on the first rotor.

Referring first to FIG. 1, there is shown an apparatus which serves for temporary storage of a stream 102 of partially overlapping folded-over paper sheets 2. The stream 102 is supplied from a suitable source (e.g., a sheet folding unit) by a system of conveyors including a first variable-speed belt or chain conveyor 1 and a second variable-speed belt or chain conveyor 5. The speed of the conveyor 5 matches that of the conveyor 1 and the speed of the conveyor 1 is monitored by a detector in the form of a tachometer generator 3 which is driven by an endless chain or belt 3*a* receiving motion from the shaft 4 for the pulley at the discharge end of the conveyor 1. The variable-speed drive means for the conveyor 1 is not shown in FIG. 1. The discharge end of the upper reach of the conveyor 1 delivers successive sheets 2 of the stream 102 onto the upper reach of the conveyor 5 which is trained over two pulleys 6, 7 respectively mounted on parallel horizontal shafts 8 and 9. The shaft 9 is journalled in the righthand end portion of an elongated frame 30 which is pivotable about the axis of the shaft 6 and forms with the conveyor 5 an elongated lever 10 whose fulcrum is at 6 and which is pivotable between the phantom-line position and the solid line position (and even downwardly beyond the solid line position) of FIG. 1. The directions in which the lever 10 is pivotable about the horizontal axis of the shaft 6 are indicated by a double-headed arrow B. The arrow D denotes the direction in which the conveyors 1 and 5 are driven when their upper reaches serve to advance the sheets 2 of the stream 102 toward the pulley 7 where the sheets 2 are confined between the convolutions 17*d* of an elongated elastic band 17 one end portion of which is detachably or permanently affixed to a first horizontal rotor 13 and the other end portion of which is detachably or permanently affixed to a second horizontal rotor 20 which is parallel to the rotor 13. The median portion 17*a* of the band 17 is trained in part over the pulley 6 and overlies the upper reach of the conveyor 5 so that it receives sheets 2 of the stream 102 from the discharge end of the upper reach of the conveyor 1.

The right-hand end portion of the frame 30 for the lever 10 is articulately connected with the piston rod of a fluid-operated motor 11 whose cylinder is articulately connected to the frame of the improved apparatus and which serves to bias the lever 10 in a counterclockwise direction (as viewed in FIG. 1) with an at least substantially constant force so that the oncoming sheets 2 on that part of the median portion 17*a* of the band 17 which overlies the upper reach of the conveyor 5 are urged against the outer side of the next-to-the-outermost convolution 17*d* of the band 17 on the core or rotor 13. A potentiometer 12 is provided to monitor the angular position of the lever 10 (and hence the radius R of the growing or expiring roll 18 of sheets 2 and convolutions 17*d* on the rotor 13 and to transmit corresponding (second) signals to the respective input of a signal processing unit 32. The other input of the signal processing unit 32 receives (first) signals from the output of the tachometer generator 3, i.e., from the (first) detector means which monitors the speed of the sheets 2 forming the stream 102 by ascertaining the speed of the conveyor 1. The parts 10, 11 and 12 together constitute a (second) detector which transmits signals denoting the actual radius R of the roll 18.

The shaft 13*a* for the rotor 13 is rotatably journalled in a stationary frame (not specifically shown) of the apparatus and the rotor 13 is driven by an adjustable drive means here shown as a variable-speed polyphase current motor 15. The output element of the motor 15 drives the rotor 13 through the medium of a V-belt 14.

The median portion 17*a* of the elastic band 17 is trained over two idler rollers 21 upstream of the location (pulley 6) where such median portion receives sheets 2 from the conveyor 1. Furthermore, the median portion 17*a* is trained over a dancer roller 22 which is disposed between the idler rollers 21 and is mounted at the free end of a lever 24 which is fulcrumed in the frame of the apparatus, as at 23, and is urged in a clockwise direction, as viewed in FIG. 1, by an adjustable fluid-operated motor 25 including a cylinder articulately connected to the frame and a piston rod articulately connected to an intermediate portion of the lever 24 so that the dancer roller 22 tends to enlarge the loop which is formed by the median portion 17*a* of the band 17 between the idler rollers 21. The motor 25 is designed to pull the lever 24 clockwise with a variable force which is determined by a force adjusting device including an adjustable pressure regulating valve 27 arranged to connect the upper chamber of the cylinder of the motor 25 with a source of pressurized gaseous or liquid medium. The angular position of the lever 24 (and hence the bias of the roller 22 upon the median portion 17*a* of the band 17 and the tension of such median portion) is monitored by a third detector including a sliding potentiometer 26 which operates between the lever 24 and the frame of the apparatus.

The lever 10 extends tangentially of the rotor 13 (when the entire band 17 is convoluted on the rotor 20) or tangentially of the outermost convolution 17*d* of the band 17 when the latter is at least partially convoluted on the rotor 13. It will be noted that the free end portion of the lever 10 is located at a level below the rotor 13, i.e., that the lever 10 bears against the rotor 13 or against the outermost convolution 17*d* of the band 17 at a locus which is disposed at or close to the lowermost point of the roll 18. The arrow A indicates the direction in which the motor 15 drives the rotor 13 in order to increase the diameter of the roll 18.

The band 17 is preferably made of an elastomeric material, e.g., of natural rubber or an elastomeric synthetic plastic substance. If the material of the band 17 is a synthetic plastic substance, the modulus of elasticity of such substance preferably matches or approximates that of natural rubber. At any rate, such modulus of elasticity is nearer to that of rubber than to that of a metallic alloy. Presently preferred elastomeric materials which are used for the making of the band 17 undergo an elongation of at least 0.1 percent (preferably between 0.5 and 1 percent) in response to the application of a tensional stress in the range of approximately 1 $kg/mm^2$. However, it is also possible to employ bands whose elasticity is more pronounced; the cross-sectional area of a band whose elasticity is more pronounced is normally larger which contributes to higher cost of such bands. If the material of the band 17 is a synthetic plastic substance, the elastic limit of such substance can be lower than that of natural rubber but it should not be exceeded (or should not be exceeded to an appreciable or substantial extent) when the band is in actual use i.e., when the band is tensioned by the biasing means 22–25, by the motor 15 for the rotor 13 and/or by the motor 19 for the rotor 20. The reference character 16 denotes the roll which is formed by the band 17 on the rotor 16. The roll 16 contains the major part of the band 17 when the supply of stored sheets 2 on the core 13 is reduced to zero. At such time, the motor 11 maintains the lever 10 in its upper end position which is indicated in FIG. 1 by phantom lines.

When the motor for the conveyors 1 and 5 is started, i.e., when the upper reach of the conveyor 1 begins to deliver sheets 2 of the stream 102 onto the median portion 17*a* of the band 17 above the upper reach of the conveyor 5, the motors 15 and 19 are started and the motor 15 drives the rotor 13 in the direction of arrow A. The rotor 20 pays out the band 17, i.e., the diameter of the roll 16 decreases and the radius R of the roll 18 on the rotor 13 is on the increase. The lever 10 urges the freshly imprinted and loose sheets 2 of the advancing stream 102 against successive next-to-the-outermost convolutions 17*d* of the band 17. The difference between the RPM of the motor 15 and the RPM of the motor 19 for the rotor 20 is regulated in such a way that the band 17 is subjected to a longitudinal tensional stress, i.e., that the motor 19 brakes the rotor 20.

The RPM of the motor 15 is regulated by a control system 28 in dependency on several parameters including the speed of the conveyors 1 and 5 (speed of the stream 102). Such speed is denoted by (first) signals which are transmitted by the tachometer generator 3 to one input of the signal processing unit 32 which forms part of the control system 28. The RPM of the motor 15 is also a function of the radius of the roll 18, i.e., of the intensity or another characteristic of the (second) signals which are generated by the potentiometer 12 in dependency on changes in the angular position of the lever 10. The arrangement is such that the RPM of the motor 15 is controlled with a view to ensure that the speed of the band 17 in the region above the upper reach of the conveyor 5 (i.e., the peripheral speed of the roll 18) invariably matches the speed of the conveyors 1 and 5 irrespective of the radius R of the roll 18. As mentioned above, the (first) signal from the tachometer generator 3 denotes the speed of the conveyors 1 and 5, i.e., the desired peripheral speed of the roll 18. The (second) signal from the potentiometer 12 denotes the radius R of the roll 18, and the signal processing unit 32 transmits a (third) signal which denotes the desired angular speed of the first rotor 13, namely that angular speed at which the peripheral speed of the roll 18 matches the speed which is denoted by the signals which are transmitted by the tachometer generator 3. Thus, the output of the processing unit 32 transmits a reference signal which is indicative of the desired or optimum peripheral speed of the rotor 13, and such signal is compared with the (fourth) signal from the detector 36 in a signal comparing stage 32*a* of the control system 28. The stage 32*a* compares the third signal (from 32) denoting the desired angular speed of the rotor 13 with the fourth signal from the detector 36 (actual angular speed of the rotor 13), and its output transmits a signal which adjusts the speed of the motor 15 when the intensity or another characteristic of the signal from the processing unit 32 deviates from the signal which is transmitted by the detector 36.

The control system 28 further comprises a first automatic regulating unit 34 which constitutes a second signal comparing stage and serves to control the RPM of the motor 19 in dependency on the angular position of the lever 24, i.e., in response to (fifth ) signals from the potentiometer 26. The angular position of the lever 24 is indicative of the bias to which the median portion 17*a* of the band 17 is subjected by the dancer roller 22 upstream of the location (pulley 6) where the band 17 receives successive sheets 2 of the stream 102. The signals from the output of the regulating unit 34 effect an acceleration or deceleration of the motor 19 in order to ensure that the lever 24 assumes a predetermined angular position which is indicative of a predetermined tensional stress upon the band 17 between the rotors 13 and 20. The left-hand input of the regulating unit 34 receives (fifth) signals from the potentiometer 26, and the unit 34 has a second input receiving a reference signal from a suitable source 134, e.g., an adjustable potentiometer. The regulating unit 34 compares the incoming signals and transmits to the control circuit of the motor 19 a signal to change the RPM of the rotor 20 when the intensity or another characteristic of the signal from the potentiometer 26 deviates from the corresponding characteristics of the reference signal from the source 134. Actually, the (fifth ) signal from the potentiometer 26 is indirectly indicative of the peripheral speed of the roll 16 of convoluted band 17 on the rotor 20. The source 134 transmits a reference signal which is indicative of the desired or optimum peripheral speed of the roll 16 on the second rotor 20.

The tensional stress upon the band 17 between the rotors 13 and 20 is a function of the radius R of the roll 18 as well as a function of the force with which the motor 25 biases the lever 24 and its dancer roller 22 in a clockwise direction, as viewed in FIG. 1. The radius R of the roll 18 is monitored by the potentiometer 12 whose output is connected not only to one input of the signal processing unit 32 but also to one input of a second automatic regulating unit 35 which forms part of the control system 28 and can constitute a simple signal comparing stage. The other input of the second regulating unit 35 receives a signal from a transducer 127 in the conduit between the valve 27 and the chamber of the cylinder forming part of the motor 25. Thus, the signal from the transducer 127 is indicative of the actual force with which the motor 25 tensions the band 17 through the medium of the dancer roller 22. The output of the second regulating unit 35 transmits signals which are used to adjust the valve 27 when the signal from the transducer 127 deviates from the continuously varying reference signal furnished by the potentiometer 12, i.e., from the signal denoting the radius R of the roll 18 on the rotor,13.

Figure 3:
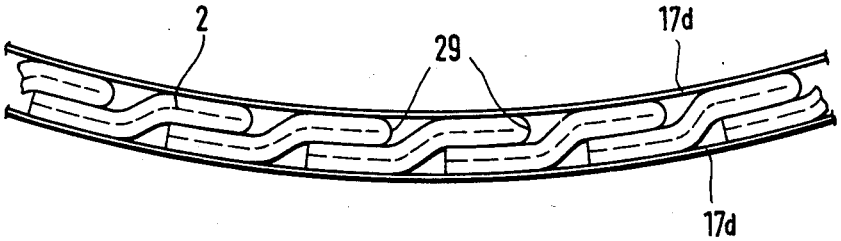
FIG. 3 is an enlarged fragmentary elevational view of two neighboring convolutions of the band on the first rotor and of a series of partially overlapping sheets between the two convolutions.
Figure 4:
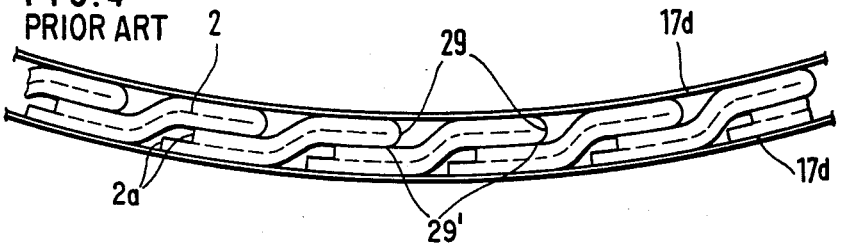
FIG. 4 PRIOR ART
FIG. 4 is a view corresponding to that of FIG. 3 but showing the sheets in positions which they assume during storage on the first rotor of a conventional apparatus wherein the band is subjected to the action of a constant braking force while the first rotor is driven in a direction to collect the band.

The mode of operation of the regulating unit 35 is such that the pressure in the chamber of the cylinder forming part of the motor 25 decreases proportionally with increasing radius R of the roll 18, i.e., that the product $R \times P$ (braking moment) is at least substantially constant (P is the force which is applied to the band 17 by the dancer roller 22). Thus, the pressure of fluid medium in the motor 25 decreases in response to increasing radius R of the roll 18 so that the tensional stress upon the band 17 in the region (at 31) where the still unconvoluted part of the median portion 17*a* of the band merges into the outermost convolution 17*d* of the band on the rotor 13 decreases proportionally with increasing diameter of the roll 18. The braking moment ($P \times R$) in the region 31 is at least substantially constant. Moreover, the elasticity of the band 17 is preferably selected in such a way that the elongation of the band is at least 0.1 percent when the winding of the sheets 2 and convolutions 17*d* onto the rotor 13 is completed, i.e., when the diameter of the roll 18 has grown to its maximum permissible value. This ensures that the band 17 can compensate for vibrations of the arched sheets 2 which are convoluted onto the rotor 13 and form part of the roll 18. This, in turn, reduces the likelihood of elongation of that portion of the band 17 which forms the convolutions 17*d* to thereby prevent any shifting of the fold lines 29 of sheets 2 from the optimum positions shown in FIG. 3 to the positions which they assume in conventional apparatus (note FIG. 4) and in which the edge faces 2*a* of the sheets opposite the respective fold lines 29 are staggered with reference to each other. In FIG. 4, shifting of the upper convolution 17*d* in a direction to the right has caused a certain displacement of the original fold line of each sheet 2 from the location 29 to the location 29'.

The mode of operation is analogous when the rotor 13 pays out the band 17 and such band is collected by the rotor 20 while the conveyors 1, 5 deliver the sheets 2 to a processing station.

An important advantage of the improved apparatus is that the peripheral speed of the growing or expiring roll 18 can match the speed of the stream 102 on the conveyors 1 and 5 in a simple but highly effective way. Another important advantage of the improved apparatus is that the speed of the band 17 can be maintained at an optimum value irrespective of whether the speed of the conveyors 1 and 5 varies within a narrow or wide range. Such speed of the band 17 can be regulated without changing the tensional stress upon the band irrespective of whether the stream 102 is accelerated or decelerated. A further important advantage of the improved apparatus is that it can (when desired or necessary) change the tensional stress upon the band 17, either arbitrarily or in dependency on changes of one or more variable parameters, e.g., the radius R of the roll 18. Still another important advantage of the improved apparatus is that it prevents a loosening of convolutions of the sheets 2 in the roll 18 irrespective of whether the sheets are thin (and hence rather incompressible) or thick (fluffy) and hence capable of undergoing at least some compression, as considered in the radial direction of the rotor 13.

The components 32, 32*a*, 34 and 35 can be of the type 760 manufactured and sold by Maschinenfabrik Stahlkontor Weser Lenze GmbH & Co., Hameln, Federal Republic Germany. The motors 15 and 19 are usual three-phase motors.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for storing or paying out a stream of sheets, particularly a stream of partially overlapping folded paper sheets, comprising first and second rotors; a band having first and second end portions affixed to the respective rotors and an elongated median portion which is convoluted on said second rotor prior to storing of sheets and on said first rotor prior to paying out of stored sheets; adjustable drive means for rotating said first rotor at a variable speed in a direction to convolute the band thereon with attendant unwinding of the band from said second rotor; variable-speed conveyor means for supplying the sheets of said stream onto the median portion of said band at a predetermined location intermediate said rotors so that the sheets are confined between the convolutions of said band when said first rotor is rotated in said direction whereby the first rotor accumulates a growing roll of convoluted sheets alternating with convolutions of said band; first detector means arranged to monitor the speed of said conveyor means and to generate first signals denoting such speed; second detector means arranged to monitor the radius of the roll on said first rotor and to generate second signals denoting said radius; means for processing said first and second signals and for generating third signals denoting the desired angular speed of said first rotor; third detector means for monitoring the angular speed of said first rotor and for generating fourth signals denoting the monitored angular speed of said first rotor; and means for adjusting said drive means when the characteristics of said third signals deviate from those of said fourth signals so that the actual angular speed of said first rotor matches said desired speed.

2. The apparatus of claim 1, wherein said second detector means comprises a pivotable lever, means for biasing said lever against the outermost convolution of the band on said first rotor, and means for generating said second signals as a function of angular positions of said lever.

3. The apparatus of claim 1, further comprising adjustable second drive means arranged to rotate said second rotor independently of the drive means for said first rotor, means for biasing said band with a variable force upstream of said predetermined location, as considered in said direction, fourth detector means arranged to monitor the bias of said biasing means and to generate fifth signals denoting the monitored bias, and regulating means for adjusting the speed of said second drive means including means for comparing said fifth signals with a predetermined reference signal.

4. The apparatus of claim 3, wherein said second drive means comprises a motor which is arranged to brake said second rotor when said first named drive means is operative to convolute the band onto said first rotor.

5. The apparatus of claim 3, further comprising means for varying the force of said biasing means.

6. The apparatus of claim 5, wherein said force varying means is adjustable and further comprising second regulating means including means for comparing said second signals with a selected reference signal and for adjusting said force varying means when the characteristics of said second signals deviate from those of said selected reference signal.

7. The apparatus of claim 6, wherein said second regulating means includes means for reducing the force of said biasing means in response to increasing radius of the roll on said first rotor and increasing the force of said biasing means in response to decreasing radius of the roll on said first roller.

8. The apparatus of claim 6, wherein said second regulating means includes means for adjusting the force varying means so that the magnitude of said force increases when the radius of the roll on said first rotor decreases and decrease when the radius of the roll on said rotor increase and the product of P and R is at least substantially constant, P being said force and R being the radius of the roll on said first rotor.

9. The apparatus of claim 1, wherein at least one of said first and third detector means comprises a tachometer generator.

10. The apparatus of claim 1, wherein said second detector means comprises a potentiometer.

11. The apparatus of claim 1, wherein said band is at least slightly elastic.

12. The apparatus of claim 1, wherein said drive means comprises a variable-speed electric motor.

* * * * *